US006216433B1

(12) United States Patent
Stahlecker

(10) Patent No.: US 6,216,433 B1
(45) Date of Patent: Apr. 17, 2001

(54) FLYER DRAFTING ARRANGEMENT HAVING A CONDENSING ZONE

(75) Inventor: Hans Stahlecker, Suessen (DE)

(73) Assignee: Spindelfabrik Suessen, Schurr, Stahlecker & Grill GmbH, Suessen (DE)

( * ) Notice: Subject to any disclaimer, the term of this patent is extended or adjusted under 35 U.S.C. 154(b) by 0 days.

(21) Appl. No.: 09/488,635

(22) Filed: Jan. 21, 2000

(30) Foreign Application Priority Data

Jan. 21, 1999 (DE) ..... 199 02 194

(51) Int. Cl.[7] ..... D01H 5/28

(52) U.S. Cl. ..... 57/315; 57/328; 19/150; 19/246

(58) Field of Search ..... 19/150, 236–250, 19/252, 263, 286–288, 304–308; 57/304, 308, 315, 328, 333

(56) References Cited

U.S. PATENT DOCUMENTS 4,953,349 * 9/1990 Fehrer ..... 57/315
5,090,192 * 2/1992 Stahlecker ..... 57/328
5,228,281 * 7/1993 Stahlecker ..... 57/328
5,600,872 * 2/1997 Artzt et al. ..... 19/244
5,996,181 * 12/1999 Fuchs ..... 19/150
6,052,872 * 4/2000 Lang et al. ..... 19/288

FOREIGN PATENT DOCUMENTS

0455199B1 11/1991 (EP) .

* cited by examiner

*Primary Examiner*—John J. Calvert
*Assistant Examiner*—Gary L. Welch
(74) *Attorney, Agent, or Firm*—Evenson, McKeown, Edwards & Lenahan, P.L.L.C.

(57) ABSTRACT

Flyer drafting arrangements deliver drafted fiber strands, whose width is greater than their height. Because of this, a condensing zone is often arranged downstream of the flyer drafting arrangements, which bundles the respective fiber strand laterally. Up to now, such condensing zones comprised mechanical condensers, which produced very unsatisfactory results. It is therefore provided in the present invention that a pneumatic condensing device is arranged at the condensing zone arranged downstream of the flyer drafting rollers. This condensing device can comprise a suction slit extending essentially in transport direction of the fiber strand, which suction slit is covered by an air-permeable transporting surface which guides the fiber strand.

28 Claims, 2 Drawing Sheets

FLYER DRAFTING ARRANGEMENT HAVING A CONDENSING ZONE

BACKGROUND AND SUMMARY OF THE INVENTION

This application claims the priority of German patent application no. 199 02 194.5, filed in Germany on Jan. 21, 1999, the disclosure of which is expressly incorporated by reference herein.

The present invention relates to a flyer drafting arrangement having a condensing zone, arranged downstream of drafting rollers and bordered by a nipping point, for condensing a drafted fiber strand.

A flyer drafting arrangement is prior art in European published patent 455 190. Here it is disclosed that the drafted fiber strand exiting from the front roller pair of the flyer drafting arrangement is wider than it is high and therefore is laterally bundled in a condensing zone downstream of the flyer drafting rollers, so that the spinning triangle, to which the twist from the flyer spindle is retroactive, becomes narrower. A mechanical sliver condenser is provided in the condensing zone, with a delivery roller pair arranged downstream of the mechanical sliver condenser, and to which the twist from the flyer spindle is retroactive.

It has been shown in practice that such mechanical sliver condensers are not entirely satisfactory and that the condensed fibers spread out again before reaching the nipping point after they have left the sliver condenser. Furthermore, it has been shown that sliver condensers always result in a disimprovement in the evenness of the fiber strand.

It is an object of the present invention to create a condensing zone in which the fiber strand drafted in a flyer drafting arrangement is rounded in a satisfactory way so that the condensing effect is not lost.

This object has been achieved in accordance with the present invention in that a pneumatic condensing device is arranged at the condensing zone.

The present invention is based primarily on the knowledge that a pneumatic condensing device not only laterally bundles the drafted fiber strand, but also that it rolls the outer fibers additionally around the core strand, so that the condensing effect is maintained up to the nipping point. The drafted fiber strand is simultaneously rounded to a great extent, so that the twist applied subsequently by the flyer spindle is more even than is the case with the known mechanical sliver condenser.

The desired improvement attained in the condensing zone, arranged downstream of the flyer drafting rollers, is maintained until the ring spinning machine, at which the flyer roving is now more easily drafted. Due to the more even twist of the flyer roving, the twist in the subsequent ring yarn is also significantly more even.

The condensing zone is particularly simply designed when the condensing device comprises a suction device. The suction device can have a suction slit extending essentially in transport direction of the fiber strand, which suction slit is covered by an air-permeable transporting surface which transports the fiber strand. The width of the suction slit determines to a great extent the condensing effect, while the air-permeable transport surface ensures to a great extent a homogenous effect of the pneumatic condensing.

The condensing effect can be particularly great when the suction slit extends to the nipping point. This effectively prevents the condensed fiber strand from spreading out again before reaching the nipping point.

The transporting surface can have various designs. It is contemplated to form the transport surface by at least one guiding apron or to apply a sieve roller. The air-permeable effective width of the transport surface should be wider than that of the suction slit, which in turn should be wider than the width of the condensed fiber strand.

Other objects, advantages and novel features of the present invention will become apparent from the following detailed description of the invention when considered in conjunction with the accompanying drawings.

DETAILED DESCRIPTION OF THE DRAWINGS

Figure 1:
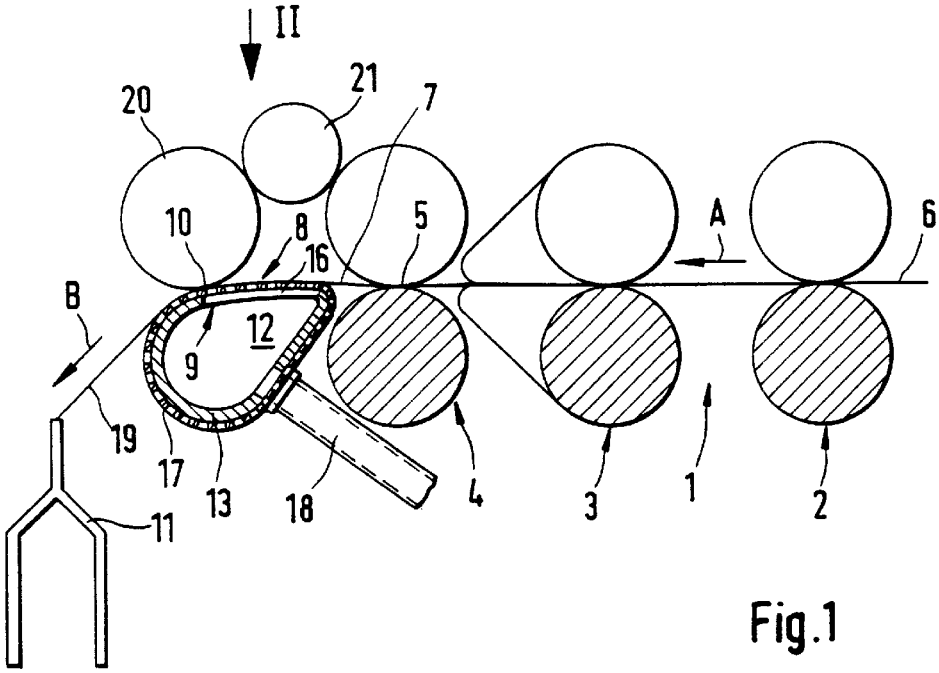
FIG. 1 is a partly sectional side view of a schematically shown flyer drafting arrangement having a pneumatic condensing device arranged downstream thereof, constructed according to a preferred embodiment of the present invention.

The flyer drafting arrangement 1 shown in FIG. 1 comprises in a known way an entry roller pair 2, an apron roller pair 3 as well as a front roller pair 4, which forms a front nipping line 5. In the flyer drafting arrangement 1, a drafter sliver 6 is drafted in transport direction A to the desired degree of fineness and transported from the front roller pair 4 as a drafted fiber strand 7, see also FIG. 2.

Due to the large mass of the sliver 6, the drafted fiber strand 7 has, downstream of the front nipping line 5, a width which is significantly wider than its height. If the fiber strand 7 were twisted in such a state, a roving with very uneven twist distribution would arise. This uneven twist distribution would be carried over into the subsequent ring yarn. For this reason, a so-called condensing zone 8 is arranged downstream of the flyer drafting arrangement 1, in which the drafted fiber strand 7 is held twist-free, but condensed by lateral bundling and rounding.

According to the present invention, the condensing zone 8 comprises a pneumatic condensing device 9, which ensures that the condensing effect is maintained to the nipping point 10 which borders the condensing zone 8 on its exit side. The nipping point 10 forms then a twist block in relation to a flyer spindle 11 arranged downstream, to which the condensed fiber strand 19 is fed in delivery direction B.

The pneumatic condensing device 9 has a suction device 12, which comprises a hollow profile 13, which extends over a plurality of spinning stations 14,15, . . . for example a machine section. The outer contour of the hollow profile 13 comprises, on the side facing the fiber strand 7, per spinning station 14,15 a suction slit 16, over which a guiding apron 17 slides. The guiding apron 17 is air-permeable as a result of a perforation, and forms a transport surface which slides over the hollow profile 13, which transport surface transports the condensed fiber strand 7 through the condensing zone 8.

The respective suction slit 16 is wider than the condensed fiber strand 19 and has a length which extends to the nipping point 10. The suction slit 16 can extend inclined at a very slight angle to the transport direction A, so that the fiber strand 7 is imparted a slight false twist during condensing.

In the case of the guiding apron 17, a thin closely woven material is preferred, which is made of, for example, plastic, so that its edges can be strengthed by means of welding. The effective width of the perforation of the guiding apron 17 is in any case so large that the entire suction slit 16 is covered.

Each hollow profile 13 comprises at least one suction connection 18, for example one per machine section. A suction fan can hereby be arranged at each suction connection 18.

The nipping point 10 is formed by a nipping roller 20, which presses the guiding apron 17 and the fiber strand 7 against the sliding surface of the hollow profile 13 and at the same time drives the guiding apron 17. The nipping roller 20 is in. turn driven by means of a transfer roller 21 by the front roller pair 4. The transfer roller 21 can be coupled with the nipping roller 20 by means of intermediate wheels in such a way that the speed of the fiber strand 7 at the nipping point 10 is somewhat larger than at the front nipping line 5.

Figure 2:
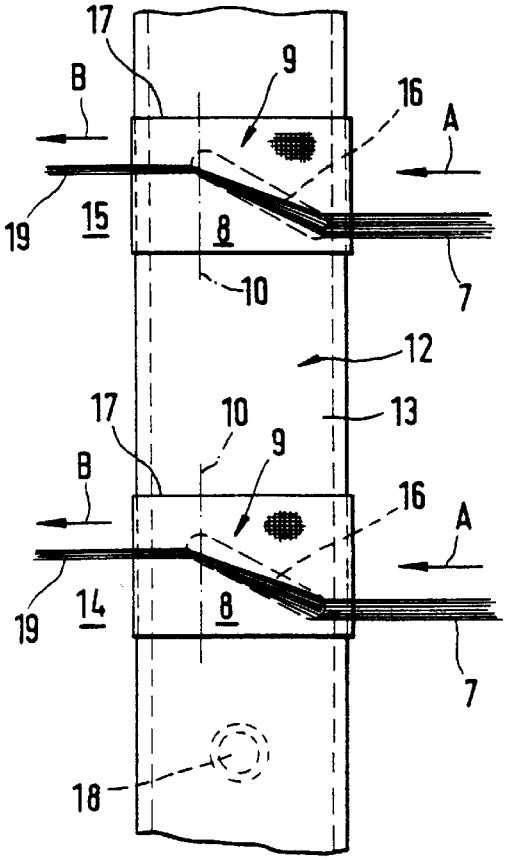
FIG. 2 is a view in the direction of the arrow II of FIG. 1 onto the condensing device of two adjacent spinning stations.

In the following embodiments to be described, the same components, which are identical to those components shown in FIGS. 1 and 2, are provided with the same reference numbers, so that a repeat description can be omitted.

Figure 3:
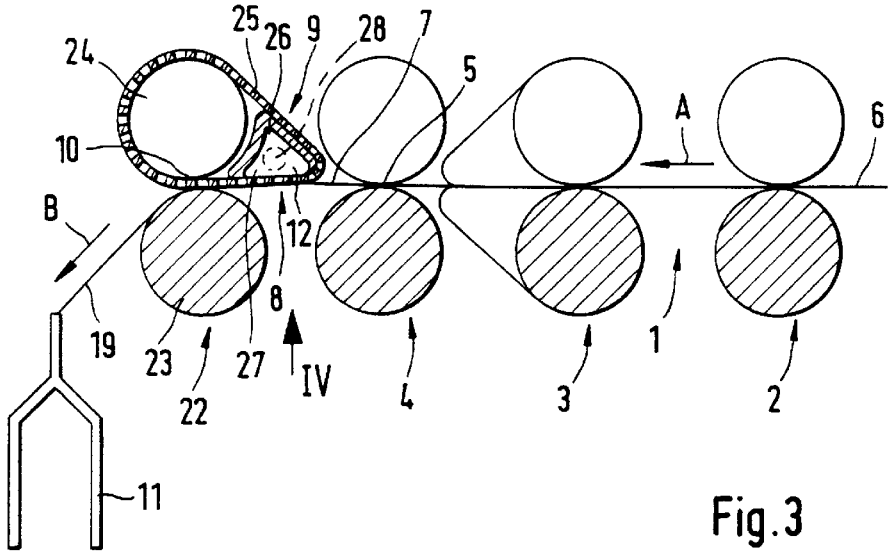
FIG. 3 is a view similar to FIG. 1 having a different embodiment of a condensing device.
Figure 4:
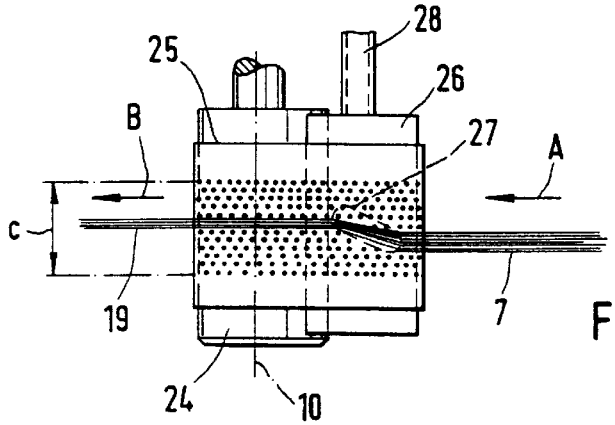
FIG. 4 is a view in the direction of the arrow IV of Figure III onto the condensing device.

In the embodiment according to FIGS. 3 and 4, a delivery roller pair 22 is arranged downstream of the flyer drafting arrangement 1, which delivery roller pair 22 comprises a driven bottom roller 23 extending in machine longitudinal direction, as well as a top roller 24. The delivery roller pair 22 with its nipping point 10 borders the condensing zone 8, arranged downstream of the flyer drafting arrangement 1, on its exit side. Here again a pneumatic condensing device 9 is arranged at the condensing zone 8.

The top roller 24 is looped by a perforated guiding apron 25 and drives same. The top roller 24 is in turn driven by the bottom roller 23 by means of friction. The guiding apron 25 extends from the front roller pair 4 over the entire condensing device 9 and slides over a sliding surface of a suction box 26, which again comprises a suction slit 27 facing the fiber strand 7 and extending essentially in transport direction A. This suction slit 27, however, cannot extend as far as the nipping point 10. The suction box 26 has a suction connection 28.

As can be seen from FIG. 4, the effective width c of the perforation of the guiding apron 25 is wider than the width of the suction slit 27, so that a very homogenous suction airstream is generated.

Figure 5:
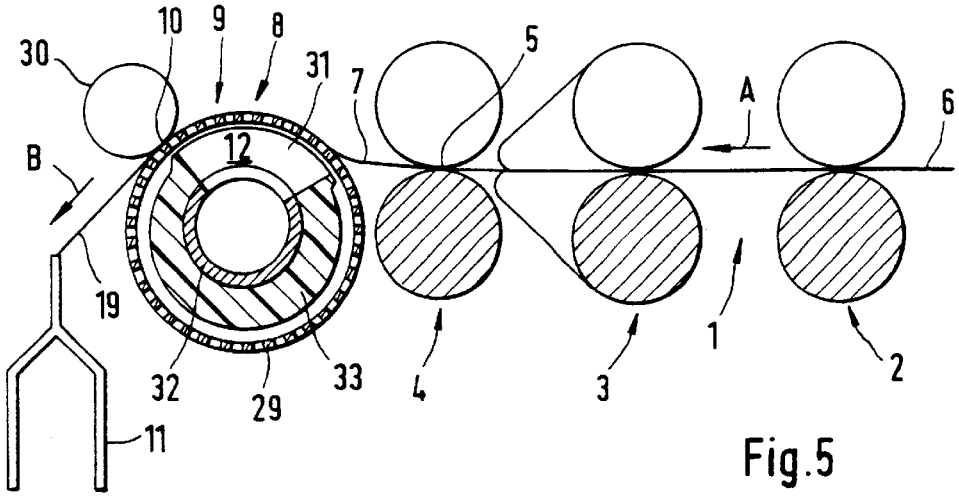
FIG. 5 is a view similar to FIGS. 1 and 3 onto a condensing device comprising a sieve roller.

In the embodiment according to FIG. 5 the condensing zone 8 comprises a pneumatic condensing device 9, which comprises a sieve roller 29. The diameter of the sieve roller 29 is significantly larger than the individual diameters of the entry roller pair 2, the apron roller pair 3 and the front roller pair 4 of the flyer drafting arrangement 1.

At a relatively large distance from the front nipping line 5, the condensing zone 8 is bordered by a relatively small nipping roller 30, on its exit side, which nipping roller 30 lightly presses the fiber strand 7 to the surface of the sieve roller 29 and defines a nipping point 10, to which the twist, applied by the flyer spindle 11, is retroactive.

In the inside of the sieve roller 29 a suction slit 31 is located, which again extends essentially in transport direction A. The sieve roller 29 is supported on a suction tube 32 in a way not shown, on which an adjustable suction insert 33 is applied, which determines the suction slit 31.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. A yarn spinning system comprising:

a drafting unit operable to draft a fiber strand, a condensing unit arranged downstream of the drafting unit and operable to condense the fiber strand, and a flyer spindle arranged downstream of the condensing unit and operable to apply spinning twist to the fiber strand, wherein the condensing unit includes a pneumatic condensing device.

2. A yarn spinning system according to claim 1, wherein the condensing device comprises a suction device.

3. A yarn spinning system according to claim 2, wherein the suction device comprises a suction slit extending essentially in transport direction of the fiber strand, which suction slit is covered by an air-permeable transport surface which guides the fiber strand.

4. A yarn spinning system according to claim 3, wherein the transport surface is formed by at least one guiding apron.

5. A yarn spinning system according to claim 4, wherein the transport surface has an air-permeable effective width which is wider than the width of the suction slit.

6. A yarn spinning system according to claim 4, wherein the suction slit is wider than the condensed fiber strand.

7. A yarn spinning system according to claim 3, wherein the transport surface is formed by a sieve roller.

8. A yarn spinning system according to claim 7, wherein the transport surface has an air-permeable effective width which is wider than the width of the suction slit.

9. A yarn spinning system according to claim 7, wherein the suction slit is wider than the condensed fiber strand.

10. A yarn spinning system according to claim 3, wherein the transport surface has an air-permeable effective width which is wider than the width of the suction slit.

11. A yarn spinning system according to claim 10, wherein the suction slit is wider than the condensed fiber strand.

12. A yarn spinning system according to claim 3, wherein the suction slit is wider than the condensed fiber strand.

13. A yarn spinning system according to claim 3, wherein the condensing unit forms a condensing zone which ends at a nipping point.

14. A yarn spinning system according to claim 13, wherein the suction slit extends to the nipping point.

15. A yarn spinning system according to claim 14, wherein the transport surface is formed by at least one guiding apron.

16. A yarn spinning system according to claim 14, wherein the transport surface is formed by a sieve roller.

17. A yarn spinning system according to claim 14, wherein the transport surface has an air-permeable effective width which is wider than the width of the suction slit.

18. A yarn spinning system according to claim 14, wherein the suction slit is wider than the condensed fiber strand.

19. A yarn spinning system according to claim 3, wherein said suction slit extends at a slight angle to the transport direction of the fiber strand.

20. A yarn spinning system according to claim 1, wherein the condensing unit forms a condensing zone which ends at a nipping point disposed upstream of the flyer spindle.

21. A method of spinning yarn comprising:

drafting a sliver strand in a drafting unit to form a drafted sliver strand, condensing the drafted fiber strand in a pneumatic condensing unit arranged downstream of the drafting unit, and applying twist to the fiber strand by a flyer spindle arranged downstream of the condensing unit.

22. A method according to claim 21, wherein said pneumatic condensing unit includes a suction device with a suction slit extending essentially in a transport direction of the fiber strand adjacent a fiber strand transport surface.

23. A method according to claim 22, wherein said suction slit extends at a slight angle to the transport direction of the fiber strand.

24. A method according to claim 22, wherein the transport surface is formed by at least one guiding apron.

25. A method according to claim 22, wherein the transport surface is formed by a sieve roller.

26. A method according to claim 22, wherein the transport surface has an air-permeable effective width which is wider than the width of the suction slit.

27. A method according to claim 22, wherein the suction slit is wider than the condensed fiber strand.

28. A method according to claim 21, wherein the condensing unit forms a condensing zone which ends at a nipping point disposed upstream of the flyer spindle.

* * * * *